US006126572A

United States Patent [19]

Smith

[11] Patent Number: 6,126,572

[45] Date of Patent: Oct. 3, 2000

[54] APPARATUS FOR MONITORING AND DISPLAYING EXERTION DATA

[75] Inventor: Carl M. Smith, 1316 Bishop La., Alexandria, Va. 22302

[73] Assignee: Carl M. Smith, Alexandria, Va.

[21] Appl. No.: 09/343,679

[22] Filed: Jun. 30, 1999

Related U.S. Application Data

[63] Continuation-in-part of application No. 09/314,026, May 19, 1999.

[51] Int. Cl.[7] ..... A63B 22/00

[52] U.S. Cl. ..... 482/4; 482/900; 73/379.02

[58] Field of Search ..... 482/1–9, 83, 84, 482/900–902; 73/379.01, 379.02

[56] References Cited

U.S. PATENT DOCUMENTS

| | | | |
|---|---|---|---|
| 4,763,284 | 8/1988 | Carlin | 273/445 |
| 4,941,660 | 7/1990 | Winn et al. | 434/247 |
| 5,163,443 | 11/1992 | Fry-Welch et al. . | |
| 5,258,927 | 11/1993 | Havriluk et al. | 482/111 |
| 5,435,315 | 7/1995 | McPhee et al. . | |
| 5,605,336 | 2/1997 | Gaoiran et al. | 434/247 |
| 5,720,711 | 2/1998 | Bond et al. . | |
| 5,723,786 | 3/1998 | Klapman | 73/379.04 |
| 5,904,639 | 5/1999 | Smyser et al. . | |

*Primary Examiner*—Glenn E. Richmon
*Attorney, Agent, or Firm*—Rabin & Champagne, P.C.

[57] ABSTRACT

An apparatus for monitoring and displaying information related to pressure exerted at a point of interest during an isometric exercise includes a fabric base, adapted to receive a body part. A sensor is attached to the fabric base and disposed at the point of interest during the isometric exercise, and measures a pressure magnitude at the point of interest and provides a pressure signal corresponding to the pressure magnitude. A monitor, which receives the pressure signal, processes the pressure signal to derive information that is meaningful to a user, and generates a display signal corresponding to the information derived from the pressure signal. The monitor is coupled by a wireless link to a processing device, which receives the display signal. A display device receives the display signal from the processing device and provides a visual indication of the information to the user. The visual indication of the information may be a metaphorical representation of the pressure signal. The fabric base includes an opening for receiving a thumb. The sensor is attached to the fabric base on a first side of the opening, and the monitor device is attached to the fabric base on a second side of the opening.

40 Claims, 6 Drawing Sheets

APPARATUS FOR MONITORING AND DISPLAYING EXERTION DATA

REFERENCE TO RELATED APPLICATION

This is a continuation-in-part of a U.S. patent application Ser. No. 09/314,026 filed on May 19, 1999, having the same title [the serial number for which has not yet been assigned].

FIELD OF THE INVENTION

The present invention relates in general to resistance exercise systems. In particular, the present invention relates to a device that monitors the effort of a person performing a resistance exercise and provides feedback on that person's performance.

BACKGROUND OF THE INVENTION

Physical fitness is a growing concern among people around the world. As a result, activities involving all forms of exercise have become increasingly popular. While many people limit their activities to cardiovascular-type exercises, others have discovered the many benefits of resistance training. Resistance training belongs to the category of exercise systems in which the muscles are worked to partial or total failure against an opposing force, usually gravity or a spring force of some type. Through proper nutrition and rest, the muscles recover such that they are stronger than before the failure was induced. Resistance training in general has been shown to increase lean muscle mass, strengthen joints, improve posture, and raise metabolic levels. It is generally believed that maximum health benefits can be obtained by following an exercise program including a combination of cardiovascular and resistance training. Thus, resistance training should form at least a component of a person's exercise regimen.

Traditionally, people have gone to gyms having weight rooms in order to perform resistance training. These weight rooms are typically equipped with free weights and resistance training machines, such as Nautilus® equipment. Membership fees to these gyms can be expensive, however. Further, memberships are frequently oversold, resulting in long waits to use equipment. Many people will not tolerate the inconvenience of working out in a gym, while others are intimidated at the idea of working out in the company of strangers.

The inconvenience and expense of exercising in a gym has led to the proliferation of products designed to provide resistance training capability in the home. These products range from large machines, such as universal gym machines, to smaller devices that can be stored in a closet. A universal gym may provide the capability to effectively train every major muscle group, but it is a large device that requires substantial space dedicated for its use. On the other hand, the smaller devices (such as hand grips) generally do not provide an effective, complete workout, as they tend to concentrate on only a single muscle group. In any case, these devices usually must be used at home or in another location; spontaneous use of these devices in public settings is often not practical.

Isometric exercises, however, may be performed virtually anywhere, anytime. Isometric exercises refer generally to resistance training of the muscles by tension, usually provided by working the muscles in opposition to each other or against a substantially immovable object. For example, resistance training of the biceps muscles may be provided by pressing the palms of the hands upward against the underside of a desktop. Likewise, resistance training of the shoulders and chest may be provided by pressing the palms of the hands together and increasing the opposing pressure.

Thus, isometric exercises may be performed at home, in the office, or even while riding public transportation. At home, a person may use opposing muscle groups to provide the necessary tension for a particular exercise. Alternatively, the person may use an object such as a doorway as a base against which to push in order to isometrically exert his muscles. In the office, a desk may be used inconspicuously as a base, or a person may exert opposing muscles against each other while reading or doing other work. Similarly, these exercises may be performed while in a taxi or airplane, or while riding a bus or subway. The flexibility and convenience provided by the very nature of isometric exercises makes it more likely that a person will stick to an exercise plan.

Isometric exercise also allows resistance training to be performed in environments in which other forms of resistance training are impossible. For example, it is entirely impractical to provide resistance training equipment to astronauts stationed in space. Payload restrictions imposed on such missions simply do not allow the stowing of heavy equipment that is not critical to the purpose of the mission. However, isometric exercises may be performed without the use of such equipment, and may be performed without leaving a particular workstation or while complying with other physical restrictions. Isometric exercise is therefore well suited for use by those involved in the space program.

Currently, isometric exercises provide an effective resistance training workout, but provide no indication of the level of work being performed or of the progress made by the person performing the exercises. That is, conventional isometric exercises provide no quantitative measure of the effort exerted by the exerciser. This makes it impossible for the exerciser to set performance goals or to track improvement. Many people require such quantitative data in order to remain motivated to continue with an exercise program.

SUMMARY OF THE INVENTION

It is therefore an objective of the present invention to provide a device that monitors certain performance characteristics of a person performing an isometric exercise.

It is a further objective of the present invention to provide a device that provides a quantitative indication of the performance level of an isometric exercise.

It is an additional objective of the present invention to provide a device that indicates to a user when a specific performance goal has been reached when performing an isometric exercise.

It is another objective of the present invention to provide a device that stores quantitative data corresponding to previous isometric exercise performance achievements.

The present invention is an apparatus for monitoring and displaying exertion data. The apparatus includes a sensor, a monitor device, a processing device, and a display device. The sensor measures a pressure change at the sensor and provides a pressure signal corresponding to a magnitude of the pressure change. The monitor device receives the pressure signal, processes the pressure signal according to processing instructions, and generates a display signal. The processing device receives the display signal and generates visual information corresponding to the display signal. The display device receives the visual information and provides a viewable representation of the visual information. The monitor device and the processing device may be coupled by a wireless link, or by a shielded electrical cable. The processing device may be a computer, a personal data assistant, a video game console, a video game receiver, a television, or a video cassette recorder. Preferably, the sensor includes a transducer against which incident pressure is applied and which generates a voltage level proportionate to a magnitude of the incident pressure, and a converter that receives the voltage level and converts the voltage level to the pressure signal. The monitor device preferably includes a first processor that receives the pressure signal, processes the pressure signal, and generates pressure data and the display signal, and program memory, in which the processing instructions are stored and which provides the processing instructions to the processor to control processing of the pressure signal. The monitor device preferably includes an output port, and transmission logic in the first processor to attach a carrier to the display signal for transmission from the output port. The processing device preferably includes an input port to receive the display signal and attached carrier, and a second processor including reception logic to remove the carrier from the display signal, as well as display memory to store the display signal. The monitor preferably includes a clock generator for providing a periodic output signal, and the pressure data may include data corresponding to an instantaneous pressure change at the sensor, data corresponding to a duration of incident pressure at the sensor, data corresponding to a duration that incident pressure at the sensor is maintained above a threshold pressure, measured by the output signal of the clock generator, data corresponding to a number of repetitions that incident pressure at the sensor crosses a threshold pressure in a positive direction, measured by the output signal of the clock generator, or data corresponding to a peak pressure incident at the sensor. The viewable representation of the visual information may include metaphorical representations of any of the quantities represented by the pressure data.

According to a particular aspect of the invention, the sensor and the monitor device are attached to a fabric base, which is preferably formed in the shape of a glove that is adapted to receive a hand. The fabric base may be formed in the shape of a loop that is adapted to wrap around a body part. Preferably, the sensor and monitor device are disposed on regions of the fabric base such that, when the fabric base is wrapped around a hand, the sensor is located proximate to the palm of the hand and the output port is located on the back portion of the hand. The output port may include an omnidirectional transmission element, and further may be connected to the first processor by a wire, disposed on the fabric away from other elements of the monitor.

According to another preferred embodiment of the invention, the apparatus for monitoring and displaying exertion data includes a pressure sensor, a monitor device, a processing device, and a display device. The pressure sensor includes detectors that measure a pressure change at the sensor and a transducer that provides a pressure signal corresponding to a magnitude of the detected pressure change. The monitor device includes a microprocessor that receives the pressure signal and provides a display signal to the processing device based on the pressure signal and in accordance with a program instruction, and a program memory for storing the program instruction. The processing device receives the display signal and processes the display signal to generate visual information. The display device receives the visual information and provides a visual indication corresponding to the pressure change.

According to a further aspect of this preferred embodiment, the apparatus further includes a fabric base, wherein the pressure sensor and the monitor device are attached to the fabric base. The fabric base is preferably formed in the shape of a loop that is adapted to wrap around a hand, and the fabric base includes an opening for receiving a thumb. Preferably, the sensor is disposed on a region of the fabric base such that, when the fabric base is wrapped around a hand and a thumb of the hand is placed through the opening, the sensor is located proximate to the palm of the hand, and the monitor device is disposed on a region of the fabric base such that, when the fabric base is wrapped around a hand and a thumb of the hand is placed through the opening, the monitor device is located on the back portion of the hand. The monitor device and the processing device may be coupled by a wireless link, or by a shielded electrical cable. The processing device may be a computer, personal data assistant, video game console, video game receiver, television, or video cassette recorder.

According to another aspect of this preferred embodiment of the invention, the monitor device includes an output port, and transmission logic in the microprocessor to attach a carrier to the display signal for transmission from the output port, and the processing device includes an input port to receive the display signal and attached carrier, and a processor including reception logic to remove the carrier from the display signal.

According to another preferred embodiment of the invention, the apparatus for monitoring and displaying information related to pressure exerted at a point of interest during an isometric exercise includes a fabric base, adapted to receive a body part, a sensor attached to the fabric base and disposed at the point of interest during the isometric exercise, and a monitor. The sensor measures a pressure magnitude at the point of interest and provides a pressure signal corresponding to the pressure magnitude. The monitor receives the pressure signal, processes the pressure signal to derive information that is meaningful to a user, and generates a display signal corresponding to the information derived from the pressure signal. The display signal may be received by a processing device having a display device to provide a visual indication of the information to the user. Preferably, the monitor device includes an output port, and transmission logic to attach a carrier to the display signal for transmission from the output port, in order to provide a wireless link to provide the display signal to the processing device. The display signal is preferably of a type that may be processed by a processing device such as a computer, personal data assistant, video game console, video game receiver, television, or video cassette recorder. Processing instructions are used by the processing device to cause a display device to provide a visual representation of the pressure signal, which may be a metaphorical representation.

BRIEF DESCRIPTION OF THE DRAWING FIGURES

These and other objectives and advantages of the present invention will be apparent from the following detailed description, with reference to the drawings, in which.

DETAILED DESCRIPTION OF THE PRESENT INVENTION

Figure 1:
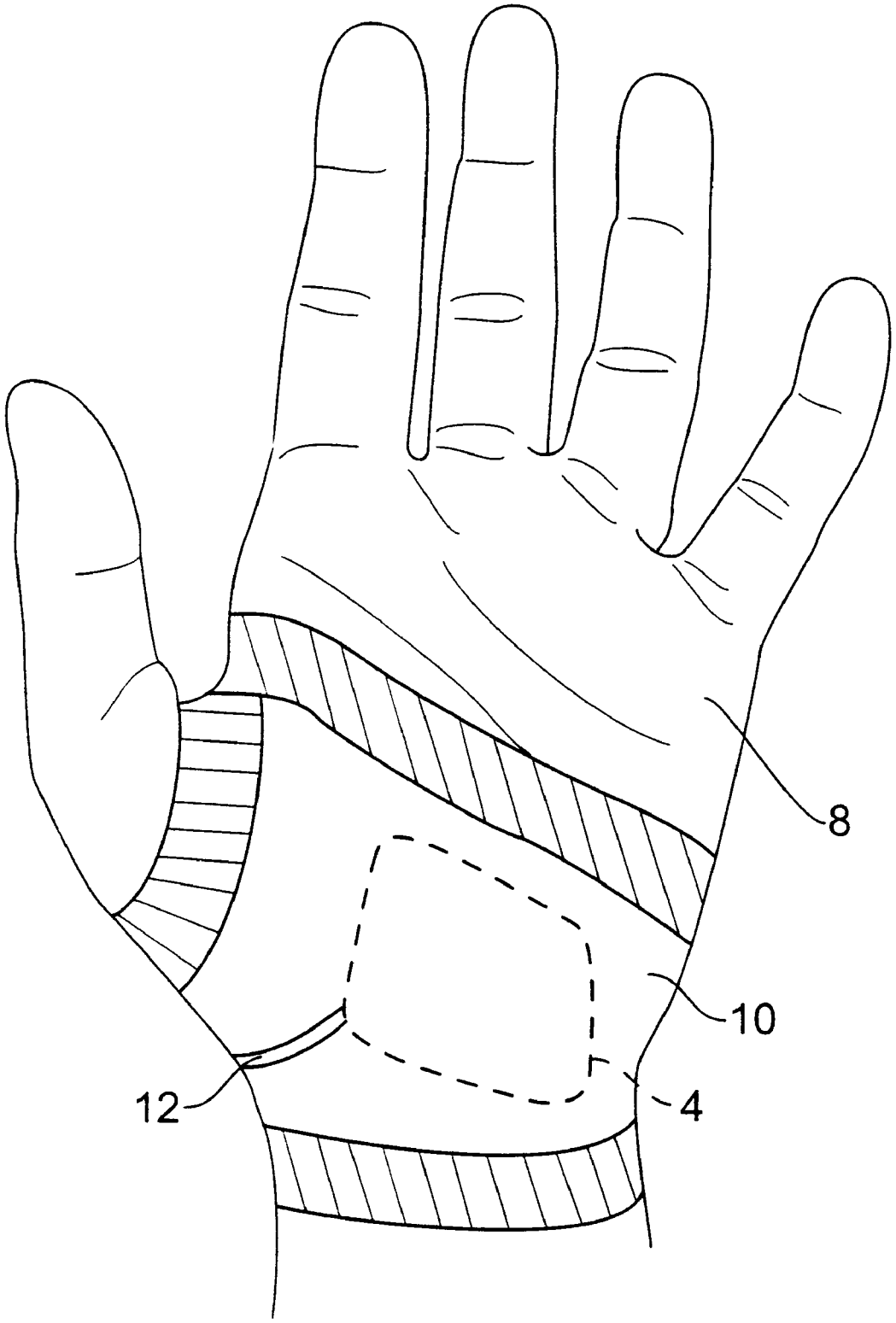
FIG. 1 shows sensors of an exemplary performance monitor of the present invention, attached to a user's hand.
Figure 2:
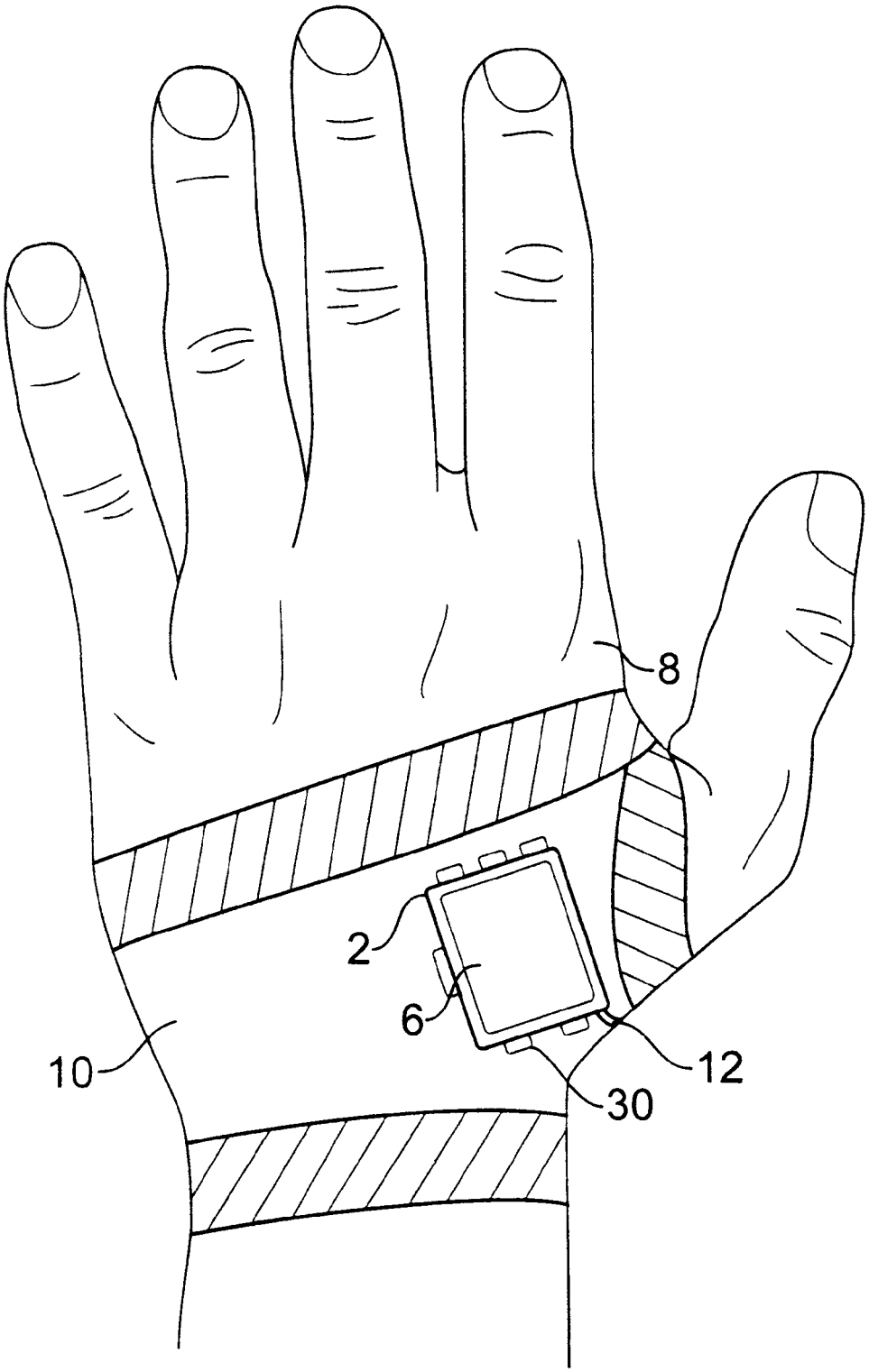
FIG. 2 shows an exemplary performance monitor and display of the present invention, worn on a user's wrist.
Figure 3:
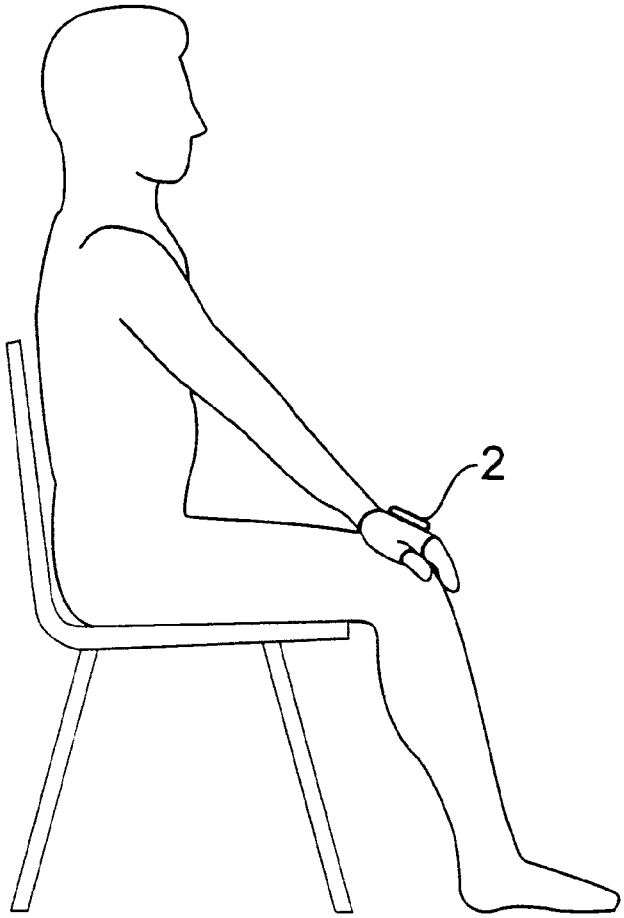
FIG. 3 shows a display of the present invention, showing performance results while the wearer performs an isometric exercise.

With reference to FIGS. 1 and 2, the device of the present invention includes three main components: a performance monitor 2, a sensor 4, and a display 6. The sensor 4 measures pressure, and attaches to the user's body at locations that will be under pressure during an isometric exercise. For example, an isometric exercise for the pectoral muscle group involves pressing the palms of the hands together at a distance in front of the person's chest. Because pressure is being exerted at the palms, that is where the sensor would be located. Alternatively, when an exercise is being performed that requires pressure to be applied against an object, the sensor may be placed on the object. For example, FIG. 3 shows an isometric exercise in which the person is pressing against his knees with both hands. It is preferable for sensors to be attached to the hands, for increased portability and convenience of the user. However, the sensors may be applied to the object instead.

As shown in FIG. 1, it is preferred that the sensor 4 be placed against the hand 8. According to a preferred embodiment of the invention, a full or partial glove 10 is worn by the user, and the sensor 4 is placed inside the glove 10, against the palm of the user's hand 8 or, preferably, is embedded or inserted within the fabric of the glove 10. The sensor 4 thus remains held in position against the hand 8 for convenience during the isometric exercise. The glove 10 may be made of any suitable material, such as nylon or leather, and may include a flexible elastic border or webbing to ensure a snug fit. Alternatively, the fit of the glove 10 may be adjustable through the use of Velcro® straps or other fasteners.

As shown in FIG. 2, the monitor 2 and display 6 are preferably constructed in a single housing, which is located on the glove 10 such that it is disposed on the back side of the user's hand 8. The monitor 2 and sensor 4 are connected by a line 12, which is preferably embedded in or sewn into the fabric of the glove 10.

The sensor 4 measures the pressure as an indication of the exertion applied by the person performing the exercise. The sensor 4 may be any known type of pressure sensor, which typically have transducers for converting the sensed pressure to electrical signals corresponding to the level of pressure sensed. It is preferable in the present invention that the sensor 4 is a digital pressure sensor that converts the sensed pressure to a digital signal, the magnitude of which corresponds to the magnitude of the sensed pressure. The sensor 4 is shown coupled to the monitor 2 by a line 12 that is an electrical wire, but these components may be coupled by some other link by which the pressure level signal is provided to the monitor 2.

Figure 4:
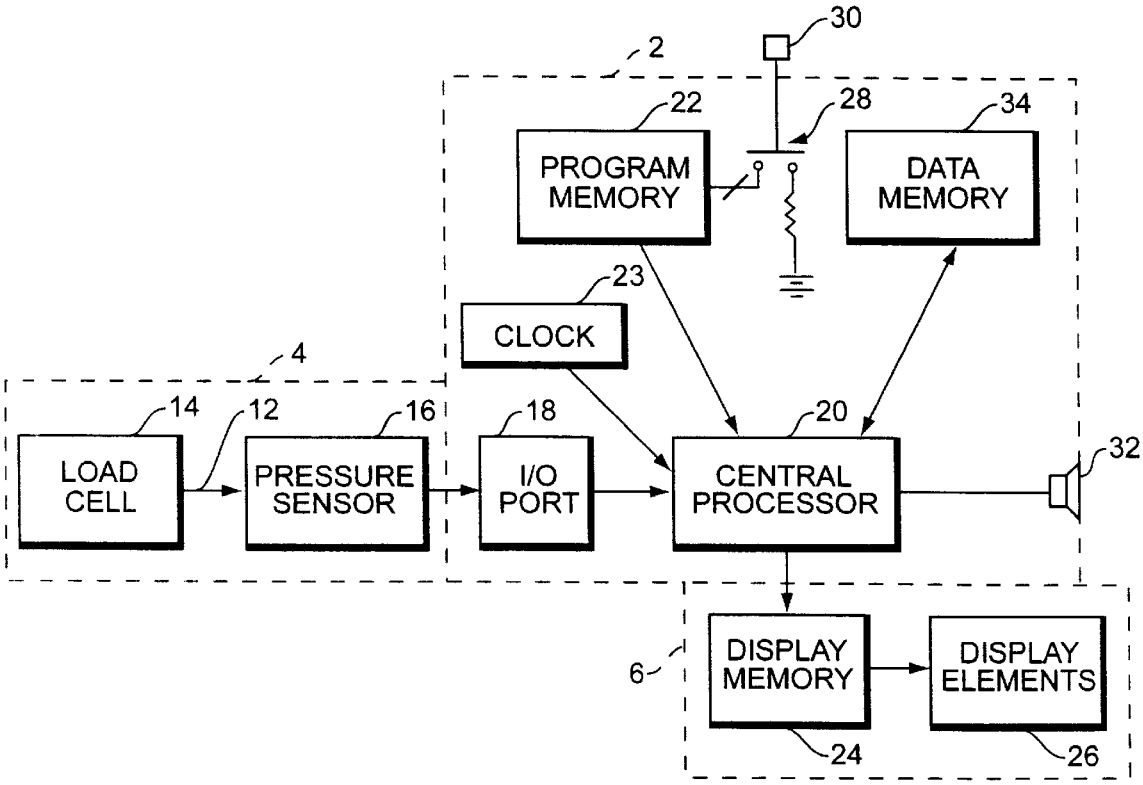
FIG. 4 shows a block diagram of a design for the performance monitor and display of the present invention.

The monitor 2 receives the pressure level signal, calculates the information desired by the user based on the signal, and displays the information to the user on the display 6. FIG. 4 shows a block diagram of an exemplary design for the sensor 4, the monitor 2, and display 6. The sensor 4 includes a load cell 14 or other transducer, for converting incident pressure to a voltage level. For example, a typical load cell 14 includes a piezoelectric crystal which, under pressure, generates a voltage level that is proportionate to the magnitude of the incident pressure. The voltage across the crystal is then provided to a pressure sensor 16, which is basically a buffer or converter for providing a pressure level signal based on the crystal voltage that is usable by the monitor 2.

The sensor 4 provides the pressure level signal to the monitor 2 on a line 12 that is preferably a bus having a width of n lines, where n is some number greater than 1. The size of n depends on the degree of granularity required in the pressure measurement, as well as the width of the input port 18 and the processing capability of the monitor 2. As shown, the monitor 2 receives the pressure level signal at the input port 18, where the signal is preferably buffered and provided to a microprocessor device. The microprocessor device, such as the central processor 20 shown in FIG. 4, processes the pressure level signal according to instructions stored in a program memory device 22, such as an EEPROM.

The microprocessor device 20 provides information as instructed to the display 6, which is coupled to the monitor 2, either within the same housing as the monitor 2 or in a remote and separate housing. The display 6 receives the information from the microprocessor device 20 and stores the information in a display memory 24. Stored information may be provided to display elements 26. Alternatively, the information may be provided directly to display drivers, which convert the information to signals that can be read by the display 6 and translated to the display elements 26. In this way, the information is displayed in some meaningful manner to the user. The display elements 26 are preferably LCD display elements, but may be any known display elements that can convert electrical signals to a visual indication that can be read by the user.

Through proper programming of the program memory device 22 with the instruction set for the microprocessor 20 and the display commands for the display device 6, the monitor 2 and display 6 may provide numerous functions and display many types of information. Preferably, the most basic function is the reading and display of the force exerted by the user in performing the current exercise. As previously described, this force corresponds to the pressure exerted at a particular point of contact, which pressure is measured by the sensor 4. Thus, the user has an immediate indication of his or her performance level for that exercise.

Another function may be the monitoring of the duration of the exercise, that is, the length of time that the user sustains pressure at the monitored point. This duration may be measured in terms of the cycle of a clock signal, which may be provided in the monitor by a clock driver circuit 23. It is a simple task for the microprocessor 20 to count the number of clock cycles that pass while a positive pressure is measured at the sensor 4, or while pressure above a certain threshold is detected. If the pressure is pulsed or otherwise periodically varied during the exercise, the monitor 2 can count repetitions as the pressure level passes above and below a predetermined threshold, and can display repetition information to the user. Based on the pressure profile provided by the peak pressure measurement, number of repetitions, and duration of repetitions, the amount of work performed during the exercise can also be calculated and displayed to the user.

The various exercise metrics can be provided to the user at strategic times during the exercise. For example, the peak pressure may be indicated when it is reached, the duration may be indicated at the end of a repetition, and the number of repetitions and amount of work performed can be indicated at the end of the exercise. Alternatively, this information may be displayed in series at the end of the exercise. As another alternative, the regular program of the microprocessor may be interrupted by the user when the user desires to have particular information displayed. This may be achieved, for example, through the use of one or more momentary switches 28 connected to address inputs of the program memory device 22. These switches 28 may be implemented as buttons 30 on the housing of the monitor. Numerous switches may be provided, each corresponding to a dedicated function stored as an instruction in the program memory device 22, which force the program memory device address to a command to the microprocessor 20 to provide the proper display information to the display 6. Alternatively, a single switch may be provided which sequences through a number of memory addresses when actuated, thereby sequencing through functions, which are displayed.

The previously-mentioned thresholds also may be set in the program memory 22 through the use of the switch 28. The thresholds can be used to count repetitions, and also can be set for a person's performance goals. For example, a person may set a peak threshold that must be reached before a repetition is counted. These thresholds may be provided in the program memory 22 at a number of different selectable levels, so that a person may step up to more difficult levels as she increases her strength on a particular exercise.

Likewise, indications may be set directly at the display 6 by the user. For example, the user may set a particular repetition duration for an exercise by actuating another switch that sequences through numbers shown on the display 6. Once set, this information may be provided to the microprocessor 20, which monitors the duration of the repetitions. When the set duration is achieved, a signal may be sent to an audio indicator 32 to alert the user that the desired duration has been achieved. This allows the user to track his repetition duration without directing his visual attention to the display device 6. Similar audible alerts can be given when a desired peak pressure is achieved, when a desired amount of work has been performed during an exercise, or when the user's selected peak level has been reached on a given repetition.

In addition to information regarding current exercise metrics, past exercise data may be displayed as well. For example, the value for a maximum pressure exerted by the user during a particular exercise may be stored in a data memory device 34. Thus, the user may check his previous best value, and strive to exceed it during the current exercise session. Even if the user does not check the previous high value prior to beginning the exercise, the monitor may provide a signal to indicate that the previous maximum has been matched or exceeded. This signal may be provided to the display 6, to the audio device 32, or to both.

As described, the present invention provides performance information to a person performing an isometric exercise. By offering a wide variety of information to the user, and flexibility on how the information is brought to the attention of the user, the person's motivation is maintained. The device of the present invention is extremely portable and may be used anywhere inconspicuously, consistent with an isometric exercise system itself. The monitor and display may be contained in a single housing that may be, for example, strapped to the user's wrist or clipped to the user's clothing. The sensors, examples of which are well-known to those of skill in the art, may be small and flexible, contributing to the small, light-weight nature of the present invention.

As noted, it is preferred that the display device uses LCD display elements. However, the display device may use other elements instead, such as LED elements for easier viewing under dark conditions, or even a CRT display, so that the progression of pressure exerted by the user over the course of a repetition may be observed.

Figure 5:
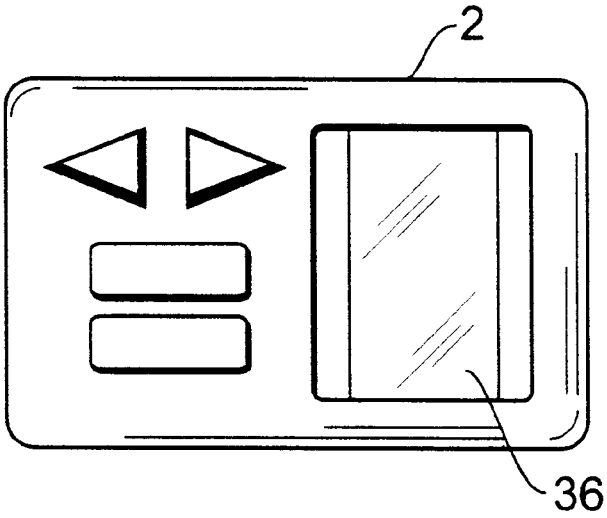
FIG. 5 shows an alternative display device of the present invention.

An alternative display 36 is shown in FIG. 5. Rather than using numerals to show the quantities representing the exercise metrics, the display graphically depicts the exertion by representing the pressure level as a bar that rises until a peak value is reached, or which incrementally grows as repetitions are achieved. Other modifications may be made to the precise manner in which data may be displayed to the user.

Further, the exemplary circuit of FIG. 4 may be modified according to fabrication considerations. For example, the program memory 22 and the data memory 34 may occupy separate parsed regions of the same memory device. Likewise, for convenience, the display memory 24 may be fabricated as part of the monitor 2, rather than as part of the display 6, or the monitor and display may be constructed together as a unit.

Figure 6:
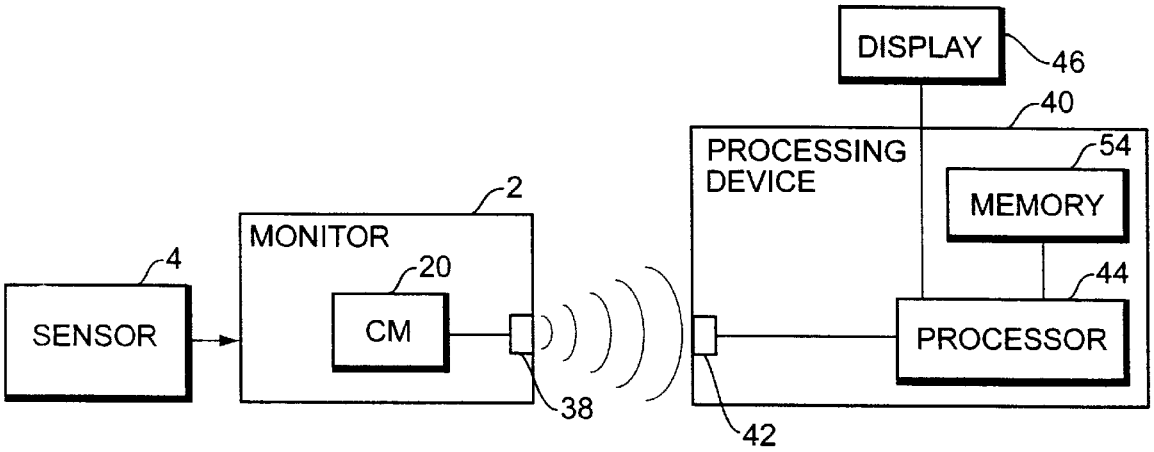
FIG. 6 shows the sensor and monitor of the invention in use with a remote processing device.

FIG. 6 shows an alternative to the dedicated display previously described. The monitor 2 of the invention may be equipped with a driver and output port 38 for providing wireless signals to a remote processing device 40. In the preferred embodiment in which the monitor 2 is mounted on a glove 10, the driver and output port 38 can be mounted separately from the monitor 2, in a more convenient place for signaling the processing device 40, and preferably include an omnidirectional transmission element. The processing device 40 is equipped with an input port 42 and processing capability 44 to receive the wireless signals and process the exertion information included in the signals. This wireless signal may have an infrared, radio frequency, or other type of carrier, as well known to those of skill in the art. The central microprocessor 20 of the sensor attaches the information to the carrier by, for example, well-known modulation methods. The resulting signal is transmitted to the processing device 40, where it is received at the input port 42 and passed to the processor 44 to strip away the carrier by, for example, demodulation. The wireless signal may be encoded or include a header, provided by the central microprocessor 20, so that transmission of the wireless signal does not interfere with reception by other devices that may be within the transmission zone of the monitor 2.

The information is then processed for presentation to the user on a display 46, which may be disposed at a location that is remote from the processing device 40, or may be constructed as a unit with the processing device 40. The processing 40 device may be designed specifically for use with the sensor and monitor of the invention, or the processing device 40 may be a computer, such as an Intel®-based PC or a Macintosh computer. Any type of device having processing capability is contemplated for use with or as part of the invention, including televisions, VCRs, video game receivers, video arcade machines, and personal data assistants (PDAs).

The information may be derived from the wireless signal, processed, and provided to the display 46 for presentation conventionally. Alternatively, the processor 44 may be may be specially designed or run software that enables the display 46 to present a more motivational or interactive representation of the exertion information to the user. This representation may be as simple as a bar graph that shows exercise progress corresponding to the force exerted at the sensor 4. The representation may be more metaphorical, showing, for example, a hill representing the user's exercise goal and a person rolling a large stone up the hill to represent the user's progress toward that goal. Such a representation would be particularly appropriate when the processing device is a computer, television, or video game device, but may be used with any combination of processing device and display.

Figure 7:
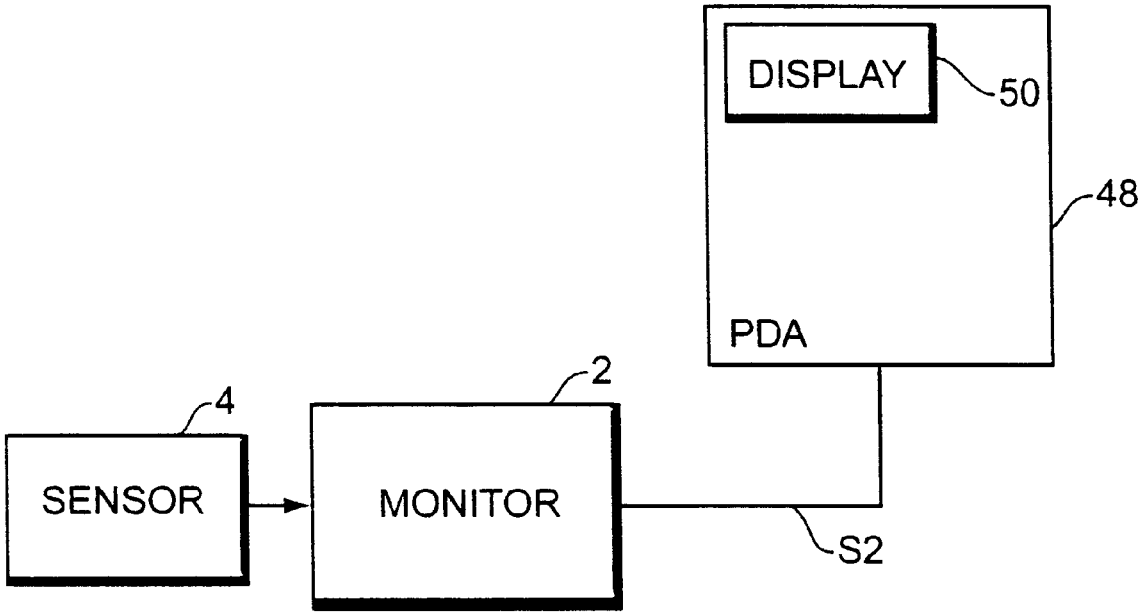
FIG. 7 shows the sensor and monitor of the invention connected for use with a personal data assistant.

FIG. 7 shows a particular embodiment of the invention, in which the processing device 40 is a PDA 48, such as a Palm Pilot® or Newton®. The PDA 48 may be connected to the monitor 2 by wireless link as described above, or through a direct physical link 52, such as a shielded electrical cable. The shielded cable can be used in situations in which electromagnetic interference is a consideration, such as aboard an aircraft. The exertion information is provided by the monitor to the PDA 48, where it is processed for presentation to the user on a display 50, as described above. The information may be presented to the user in straightforward or metaphorical format, as previously described.

The present invention may be switched by the user between use with the hand-mounted monitor 6 and the remote processing device 40, depending on the preference of the user and the circumstances under which the invention is used. An advantage of use with the remote processing device is its advanced processing capability and availability of a larger display. Further, such a device usually includes a larger amount of memory 54 or other electronic storage for storing exertion information. Thus, when a user is away from his home-based PC, she can use the invention with her PDA or laptop computer, and later transfer the exertion information to the home computer, where her main exercise database is located. In fact, the remote processing device need not have a display, but may be used to store the exertion information only. This information may later be provided to another device that has a display, and the visual representation of the workout may be reviewed at that time. Concurrent viewing of the visual representation, of course, will provide greater motivation for most people, and is therefore the preferred mode of operation of the invention.

The present invention has been described herein in a particular embodiment of an article to be worn around the hand. However, many isometric exercises do not result in pressure being applied to the hand, and therefore the fabric base on which the circuitry is fabricated may be attached to a more appropriate body part. For example, the fabric may take the form of a simple loop, which may be wrapped around a limb and fastened such that it is held in place and so that the sensor is disposed properly. In this way, for example, the calf muscles may be exercised by sitting at a desk with the feet placed on a platform so that the fronts of the thighs are touching the underside of the desktop. By pushing up against the desk with the thighs by attempting to raise the heels off the ground, the calf muscles will be stressed. Because the pressure from the exertion is best measured at the interface between the thighs and the desk, the fabric can be wrapped around the thighs, with the sensors placed between the thighs and the desk. The flexibility provided by the fabric loop allows for placement anywhere on the body, allowing for measurement of performance data of any isometric exercise.

Thus, the particular fabric article, the disclosed circuit, and other depictions of the present invention provided herein are not limiting of the present invention, but rather are preferred embodiments of the present invention as currently contemplated by the inventor, and may be modified within the spirit and scope of the present invention.

Preferred and alternative have been described in detail. It must be understood, however, that the invention is not limited to the particular embodiments described herein. Rather, the invention is defined by the following claims, which should be given the broadest interpretation possible in light of the written description and the relevant prior art.

What is claimed is:

1. An apparatus for monitoring and displaying exertion data, comprising:

a sensor that measures a change in pressure between two surfaces that are directly in contact with the sensor, and provides a pressure signal corresponding to a magnitude of the pressure change;

a monitor device that receives the pressure signal, processes the pressure signal according to processing instructions, and generates a display signal;

a processing device that receives the display signal and generates visual information corresponding to the display signal; and a display device that receives the visual information and provides a viewable representation of the visual information.

2. The apparatus of claim 1, wherein the monitor device and the processing device are coupled by a wireless link.

3. The apparatus of claim 1, wherein the monitor device and the processing device are coupled by a shielded electrical cable.

4. The apparatus of claim 2, wherein the processing device belongs to the group consisting of computers, personal data assistants, video game consoles, video game receivers, televisions, and video cassette recorders.

5. The apparatus of claim 2, wherein the sensor includes a transducer against which incident pressure is applied directly by the two surfaces and which generates a voltage level proportionate to a magnitude of the incident pressure; and a converter that receives the voltage level and converts the voltage level to the pressure signal.

6. The apparatus of claim 2, wherein the monitor device includes a first processor that receives the pressure signal, processes the pressure signal, and generates pressure data and the display signal; and program memory, in which the processing instructions are stored and which provides the processing instructions to the processor to control processing of the pressure signal.

7. The apparatus of claim 6, wherein the monitor device includes an output port, and transmission logic in the first processor to attach a carrier to the display signal for transmission from the output port.

8. The apparatus of claim 7, wherein the processing device includes an input port to receive the display signal and attached carrier, and a second processor including reception logic to remove the carrier from the display signal.

9. The apparatus of claim 8, wherein the processing device includes display memory to store the display signal.

10. The apparatus of claim 8, wherein the pressure data includes data corresponding to an instantaneous pressure change directly at the sensor.

11. The apparatus of claim 8, wherein the monitor further includes a clock generator for providing a periodic output signal, and wherein the pressure data includes data corresponding to a duration of pressure incident directly at the sensor, measured by the output signal of the clock generator.

12. The apparatus of claim 8, wherein the monitor further includes a clock generator for providing a periodic output signal, and wherein the pressure data includes data corresponding to a duration that pressure incident directly at the sensor is maintained above a threshold pressure, measured by the output signal of the clock generator.

13. The apparatus of claim 8, wherein the monitor further includes a clock generator for providing a periodic output signal, and wherein the pressure data includes data corresponding to a number of repetitions that pressure incident directly at the sensor crosses a threshold pressure in a positive direction, measured by the output signal of the clock generator.

14. The apparatus of claim 8, wherein the pressure data includes data corresponding to a peak pressure incident directly at the sensor.

15. The apparatus of claim 10, wherein the viewable representation of the visual information includes a metaphorical representation of the instantaneous pressure change at the sensor.

16. The apparatus of claim 11, wherein the viewable representation of the visual information includes a metaphorical representation of the duration of incident pressure at the sensor.

17. The apparatus of claim 12, wherein the viewable representation of the visual information includes a metaphorical representation of the duration that incident pressure at the sensor is maintained above a threshold pressure.

18. The apparatus of claim 13, wherein the viewable representation of the visual information includes a metaphorical representation of the number of repetitions that incident pressure at the sensor crosses a threshold pressure in a positive direction.

19. The apparatus of claim 14, wherein the viewable representation of the visual information includes a metaphorical representation of the peak pressure incident at the sensor.

20. The apparatus of claim 8, further including a fabric base, wherein the sensor and the monitor device are attached to the fabric base.

21. The apparatus of claim 20, wherein the output port includes an omnidirectional transmission element.

22. The apparatus of claim 21, wherein the output port is connected to the first processor by a wire, and is disposed on the fabric away from other elements of the monitor.

23. The apparatus of claim 21, wherein the fabric base is formed in the shape of a glove that is adapted to receive a hand.

24. The apparatus of claim 21, wherein the fabric base is formed in the shape of a loop that is adapted to wrap around a body part.

25. The apparatus of claim 24, wherein the sensor is disposed on a region of the fabric base such that, when the fabric base is wrapped around a hand, the sensor is located proximate to the palm of the hand.

26. The apparatus of claim 24, wherein the monitor device is disposed on a region of the fabric base such that, when the fabric base is wrapped around a hand, the output port is located on the back portion of the hand.

27. An apparatus for monitoring and displaying exertion data, comprising:

a pressure sensor;

a monitor device;

a processing device; and a display device;

wherein the pressure sensor includes detectors that measure a change in pressure between two surfaces that are directly in contact with the sensor, and a transducer that provides a pressure signal corresponding to a magnitude of the detected pressure change;

wherein the monitor device includes a microprocessor that receives the pressure signal and provides a display signal to the processing device based on the pressure signal and in accordance with a program instruction, and a program memory for storing the program instruction;

wherein the processing device receives the display signal and processes the display signal to generate visual information; and wherein the display device receives the visual information and provides a visual indication corresponding to the pressure change.

28. The apparatus of claim 27, further including a fabric base, wherein the pressure sensor and the monitor device are attached to the fabric base.

29. The apparatus of claim 28, wherein the fabric base is formed in the shape of a loop that is adapted to wrap around a hand, and wherein the fabric base includes an opening for receiving a thumb.

30. The apparatus of claim 29, wherein the sensor is disposed on a region of the fabric base such that, when the fabric base is wrapped around a hand and a thumb of the hand is placed through the opening, the sensor is located proximate to the palm of the hand; and the monitor device is disposed on a region of the fabric base such that, when the fabric base is wrapped around a hand and a thumb of the hand is placed through the opening, the monitor device is located on the back portion of the hand.

31. The apparatus of claim 30, wherein the monitor device and the processing device are coupled by a wireless link.

32. The apparatus of claim 30, wherein the monitor device and the processing device are coupled by a shielded electrical cable.

33. The apparatus of claim 30, wherein the processing device belongs to the group consisting of computers, personal data assistants, video game consoles, video game receivers, televisions, and video cassette recorders.

34. The apparatus of claim 30, wherein the monitor device includes an output port, and transmission logic in the microprocessor to attach a carrier to the display signal for transmission from the output port.

35. The apparatus of claim 34, wherein the processing device includes an input port to receive the display signal and attached carrier, and a processor including reception logic to remove the carrier from the display signal.

36. An apparatus for monitoring and displaying information related to pressure exerted at a point of interest during an isometric exercise, comprising:

a fabric base, adapted to receive a body part;

a sensor attached to the fabric base and disposed at the point of interest during the isometric exercise, wherein the sensor measures a pressure magnitude at the point of interest and provides a pressure signal corresponding to the pressure magnitude; and a monitor, which receives the pressure signal, processes the pressure signal to derive information that is meaningful to a user, and generates a display signal corresponding to the information derived from the pressure signal;

wherein the point of interest is an interface between the body part and a surface in direct contact with the sensor; and wherein the display signal may be received by a processing device having a display device to provide a visual indication of the information to the user.

37. The apparatus of claim 36, wherein the monitor device includes an output port, and transmission logic to attach a carrier to the display signal for transmission from the output port, in order to provide a wireless link to provide the display signal to the processing device.

38. The apparatus of claim 37, wherein the display signal is of a type that may be processed by a processing device that belongs to the group consisting of computers, personal data assistants, video game consoles, video game receivers, televisions, and video cassette recorders.

39. The apparatus of claim 37, further including processing instructions to be used by the processing device to cause a display device to provide a visual representation of the pressure signal.

40. The apparatus of claim 39, wherein the visual representation is a metaphorical representation.

* * * * *